US009886005B2

(12) United States Patent
White et al.

(10) Patent No.: US 9,886,005 B2
(45) Date of Patent: Feb. 6, 2018

(54) DEVICES, SYSTEMS, AND METHODS FOR RELEASABLY SEALING A PORT FOR A WEARABLE ELECTRONIC COMPONENT

(71) Applicant: NIXON, INC., Encinitas, CA (US)

(72) Inventors: Tyson White, Encinitas, CA (US); Joe Babcock, Encinitas, CA (US); Nick Everist, Encinitas, CA (US)

(73) Assignee: NIXON, INC., Encinitas, CA (US)

( * ) Notice: Subject to any disclaimer, the term of this patent is extended or adjusted under 35 U.S.C. 154(b) by 0 days.

(21) Appl. No.: 15/434,572

(22) Filed: Feb. 16, 2017

(65) Prior Publication Data

US 2017/0242401 A1 Aug. 24, 2017

Related U.S. Application Data

(60) Provisional application No. 62/299,432, filed on Feb. 24, 2016.

(51) Int. Cl.
*G04B 37/08* (2006.01)
*G04B 47/00* (2006.01)

(52) U.S. Cl.
CPC ..... *G04B 37/08* (2013.01); *G04B 47/00* (2013.01)

(58) Field of Classification Search
CPC ..... G04B 37/08; G04B 37/081
See application file for complete search history.

(56) References Cited

U.S. PATENT DOCUMENTS 2,954,665 A 10/1960 Panerai
6,198,697 B1 3/2001 Hunziker et al.
6,200,019 B1 3/2001 Latini
6,203,189 B1 3/2001 Schafer
6,210,034 B1 * 4/2001 Latini ..... G04B 37/10 368/289
7,600,430 B2 10/2009 Palin et al.
7,604,397 B2 10/2009 Cohen
(Continued)

FOREIGN PATENT DOCUMENTS

CH 696504 A5 7/2007
EP 0869412 A2 10/1998
(Continued)

OTHER PUBLICATIONS

International Search Report and Written Opinion issued in PCT/US2017/018100 dated Apr. 21, 2017 (11 pages).

*Primary Examiner* — Amy Cohen Johnson
*Assistant Examiner* — Jason Collins
(74) *Attorney, Agent, or Firm* — NorthStar Law Group; Thomas Bassolino

(57) ABSTRACT

A device for releasably sealing a port for a wearable electronic component includes a housing that seals an electronic component and includes a void for receiving the electronic component. The device may also include a cam disposed on a side surface of the housing having a proximal end pivotally engaged with the housing between a first position where a distal end of the cam is disposed adjacent to the housing and a second position where the distal end is disposed away from the housing. The cam may include a cam port that extends through a body of the cam. The device may further include a slider disposed on the side surface of the housing between the cam and the void, where the slider is slidably engaged with the housing between a sealed position and an open position.

20 Claims, 12 Drawing Sheets

(56) References Cited

U.S. PATENT DOCUMENTS

| | | | |
|---|---|---|---|
| 8,092,077 | B2 | 1/2012 | Hobor |
| 8,851,743 | B1 | 10/2014 | Lalo |
| 2014/0156196 | A1 | 6/2014 | Martinez et al. |
| 2014/0174958 | A1 | 6/2014 | Martinez et al. |
| 2014/0180019 | A1 | 6/2014 | Martinez et al. |
| 2014/0196539 | A1 | 7/2014 | Martinez et al. |
| 2014/0200412 | A1 | 7/2014 | Martinez et al. |
| 2015/0320167 | A1 | 11/2015 | Nguyen et al. |

FOREIGN PATENT DOCUMENTS

| | | | |
|---|---|---|---|
| JP | 2008252323 | | 10/2008 |
| WO | 2006/120536 | A2 | 11/2006 |
| WO | 2013/011676 | A1 | 1/2013 |
| WO | 2015/047359 | A1 | 4/2015 |
| WO | 2015/049615 | A3 | 9/2015 |

* cited by examiner

DEVICES, SYSTEMS, AND METHODS FOR RELEASABLY SEALING A PORT FOR A WEARABLE ELECTRONIC COMPONENT

CROSS-REFERENCE TO RELATED APPLICATIONS

This application claims the benefit under 35 U.S.C. § 119(e) of U.S. Provisional Application No. 62/299,432 filed on Feb. 24, 2016, the entire content of which is hereby incorporated by reference.

FIELD

The present disclosure generally relates to devices, systems, and methods for releasably sealing a port for a wearable electronic component. By way of example, the wearable electronic component may include a smartwatch and the port may include a passage for speaking into a microphone included in the smartwatch.

BACKGROUND

Wearable electronic components such as smartwatches and the like are increasing in popularity. Many wearable electronic components include voice-command technology where a user can speak into a microphone to access functionality of the device. Microphone ports and the like are often sensitive to debris ingress, particularly in environmental conditions for an active wearer who may be swimming, surfing, skiing, snowboarding, and the like. There remains a need for improved devices, systems, and methods for releasably sealing a port for a wearable electronic component.

SUMMARY

The present teachings include a device for releasably sealing a port for a wearable electronic component including a housing structurally configured to substantially hermetically seal an electronic component, where the housing includes a void for receiving the electronic component within the housing, a front, a back, and a side surface disposed between the front and the back of the housing and surrounding the void. The device may also include a cam disposed on the side surface of the housing, where the cam includes a proximal end and a distal end opposing the proximal end. The proximal end may be pivotally engaged with the housing between a first position where the distal end is disposed adjacent to the housing and a second position where the distal end is disposed away from the housing. The cam may include a cam port disposed between the proximal end and the distal end of the cam that extends through a body of the cam. The device may further include a slider disposed on the side surface of the housing at least partially between the cam and the void, where the slider is slidably engaged with the housing between a sealed position where a body of the slider substantially seals the void from an external environment and an open position where the body of the slider does not seal the void from the external environment. When the cam is in the first position and the slider is in the sealed position, the slider may be prevented from sliding to the open position by an engagement between the body of the cam and the body of the slider. When the cam is in the second position, the engagement between the body of the cam and the body of the slider may be released thereby permitting the slider to slide between the sealed position and the open position. When the cam is in the first position and the slider is in the open position, the cam port may be aligned with an opening of the housing thereby forming a passage between the external environment and the void.

These and other features, aspects and advantages of the present teachings will become better understood with reference to the following description, examples and appended claims.

BRIEF DESCRIPTION OF THE DRAWINGS

The foregoing and other objects, features and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein. In these drawings, like reference numerals identify corresponding elements.

DETAILED DESCRIPTION

Figure 1:
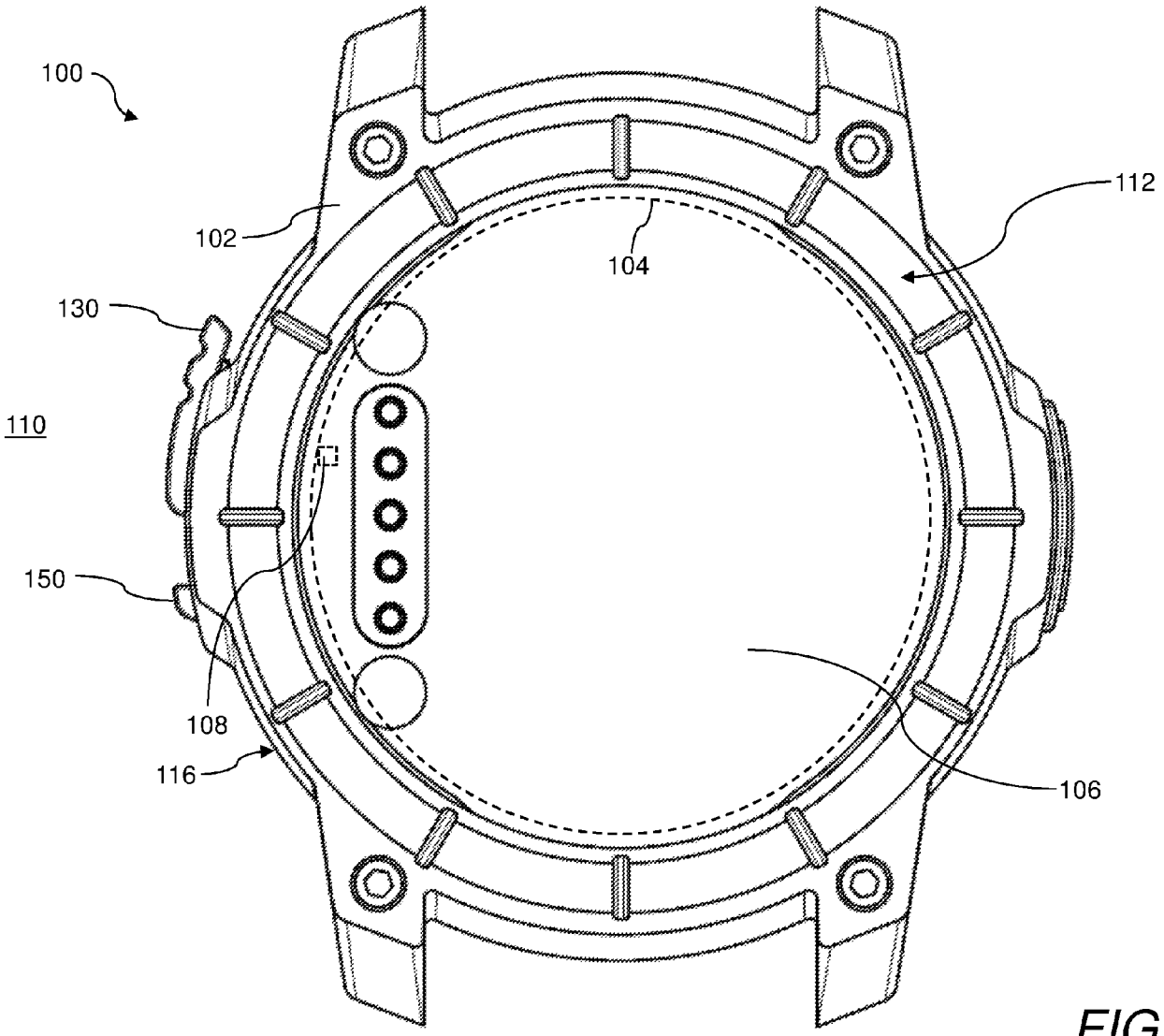
FIG. 1 is a top view of a device according to an implementation.

The embodiments will now be described more fully hereinafter with reference to the accompanying figures, in which preferred embodiments are shown. The foregoing may, however, be embodied in many different forms and should not be construed as limited to the illustrated embodiments set forth herein. Rather, these illustrated embodiments are provided so that this disclosure will convey the scope to those skilled in the art.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the embodiments.

In this document, the terms "comprises," "comprising," "includes," "including," "has," "having," or any other variations thereof, are intended to cover a non-exclusive inclusion, such that a process, method, article, or apparatus that comprises a list of elements does not include only those elements but may include other elements not expressly listed or inherent to such process, method, article, or apparatus. For example, an element preceded by "comprises . . . a" does not, without more constraints, preclude the existence of additional identical elements in the process, method, article, or apparatus that comprises the element.

Reference throughout this document to "one embodiment," "certain embodiments," "an embodiment," "implementation(s)," "aspect(s)," or similar terms means that a particular feature, structure, or characteristic described in connection with the embodiment is included in at least one embodiment of the disclosed devices, systems, and methods. Thus, the appearances of such phrases or in various places throughout this specification are not necessarily all referring to the same embodiment. Furthermore, the particular features, structures, or characteristics may be combined in any suitable manner in one or more embodiments without limitation.

In the following description, it is understood that terms such as "first," "second," "top," "bottom," "up," "down," "inward," "outward," and the like, are words of convenience and are not to be construed as limiting terms.

Described herein are devices, systems, and methods for releasably sealing a port for a wearable electronic component. In implementations, the wearable electronic component may include a smartwatch and the port may include a passage for speaking into a microphone included in the smartwatch. Thus, implementations include a device for releasably sealing a microphone port of a smartwatch thereby forming a microphone lock for the smartwatch. The devices, systems, and methods described herein may also or instead be adapted for use with other electronic components, and other ports of electronic components.

In general, implementations may include a housing having a port locking device, e.g., for a microphone of a smart watch. Devices and systems may include a lockable, sliding closure for a port or passage connecting an interior of its housing and an external environment. The sliding closure may provide access to the passage, and the sliding closure may close the passage. Devices and systems may further include a gas permeable membrane situated in the passage that provides a secondary barrier, e.g., by permitting air flow while preventing debris (e.g., oil, sand, liquid, and the like) to infiltrate the interior of the housing, which can hold one or more sensitive electronic components of a smartwatch. Specifically, in implementations, a cam lock may pivot between an open position and a closed, locked position where the cam lock provides pressure on a slider that seals the passage, and where the cam lock holds the slider in place.

Implementations may be useful for smartwatch housings and casings, e.g., for active users who may be skiing, snowboarding, swimming, surfing, hiking, camping, hunting, and the like, where environmental conditions can threaten sensitive electronics or components included in the smartwatch, particularly through otherwise exposed ports such as microphone ports, charging ports, speaker ports, headphone ports, and the like. Thus, although the description may primarily refer to releasably sealing microphone ports, one skilled in the art will recognize that implementations may be used for releasably sealing other ports or sensitive areas of electronic components (or other hardware). Similarly, although the description may primarily refer to a use case of smartwatches, one skilled in the art will recognize that implementations may be used for other devices such as phones, fitness tracking devices, and other remote computing devices.

FIG. 1 is a top view of a device according to an implementation. The device 100 may be structurally configured for releasably sealing a port for a wearable electronic component, e.g., releasably sealing a microphone port in a smartwatch or the like. The device 100 may include a housing 102 and an electronic component 104 included within the housing 102.

The housing 102 may be structurally configured to substantially hermetically seal the electronic component 104, e.g., within a void 106 of the housing 102. Thus, the housing 102 may provide a hermetic seal for the electronic component 104. The hermetic seal may create a substantially soundproof environment in the void 106, e.g., such that, when the housing 102 is sealed, a microphone 108 included on the electronic component 104 cannot be accessed by a user speaking in an external environment 110 relative to the void 106 in the housing 102. The seal provided by the housing 102, when the housing 102 is in a sealed state, may also or instead include a waterproof seal. In certain implementations, the waterproof seal provided by the housing 102 may be capable of withstanding a pressure of about 10 atmospheres or up to about a 100 meter depth in a water column. One of ordinary skill will recognize that the configuration of the housing 102, the selected materials, and so forth, may enable the housing 102 to provide a waterproof seal of pressures greater than or less than 10 atmospheres, and that any reference to an embodiment having a 10 atmosphere waterproof rating is provided by way of example only and not of limitation.

The housing 102 may be made from materials typically used for holding electronic components 104 such as smartwatches and the like. For example, the housing 102 may include one or more of a plastic, an elastomer (e.g., rubber and the like), a composite material, a ceramic, a glass, a metal, a stone or crystal, a wood, and so forth, and including any combination thereof. In certain implementations, the void 106 is surrounded by the housing 102 and visible from an external environment 110 through a top surface made of a substantially transparent material such as glass, crystal, acrylic, and the like.

As stated above, the housing 102 may include a void 106 for receiving the electronic component 104 within the housing 102. In this manner, the housing 102 may be part of a case or the like for the electronic component 104. In certain aspects, the electronic component 104 is integrated into the void 106 of the housing 102 or integrated into the housing 102 itself, such that the electronic component 104 and the housing 102 are a single unit. The housing 102 may also or instead include a structure for holding, stabilizing, or enclosing one or more elements of the electronic component 104 (e.g., electronic elements, mechanical elements, sensitive parts, and the like). In implementations, the housing 102 and the electronic component 104 are separate components, e.g., separate components in a system. In other words, a system may include the device 100 for releasably sealing a port as generally described herein and an electronic component 104 as generally described herein. The system may also or instead include other components such as mechanical components coupled with or cooperating with the device 100 or the electronic component 104, and electrical/software components coupled with or otherwise in communication with the device 100 or the electronic component 104.

The housing 102 may include a front 112, a back 114, and a side surface 116 disposed between the front 112 and the back 114 of the housing 102 and surrounding the void 106. In an aspect, the housing 102 is constructed by placing the front 112 of the housing 102 on a frame (e.g., placing glass or crystal on the side surfaces 116), and then securing the back 114 onto a bottom surface of the frame (e.g., a bottom surface of the side surfaces 116). The different elements of the housing 102 may be formed together such that the void 106 is sealed from the external environment 110 as discussed above, e.g., using seals, gaskets, and the like. In one aspect, the front 112 of the housing 102 includes an electronic display, which can include a touch screen interface or the like for a user.

As referenced above, the device 100 may be waterproof through the design of different features of the device 100 including without limitation the thickness of the housing 102, properties of the front 112 of the housing 102, properties of the back 114 of the housing 102, and properties of functional components on the housing 102. For example, the elements forming the structure/walls of the housing 102 may be designed to withstand 10 ATM/100M pressure, and to avoid deflection. This can be achieved by a specific design shape and curvature, as well as general part thicknesses. By way of another example, the front 112 of the housing 102 may include a face constructed of a crystal/glass designed to withstand about 10 ATM/100M pressure, and to avoid deflection. This can be achieved by pressure fitting the face inside a tension-ring onto the housing structure, and through a specific design shape and curvature, as well as general part thicknesses. By way of another example, the back 114 of the housing 102 may be designed to engage with gaskets and seal against the housing structure to prevent water ingress, where it is also designed to withstand about 10 ATM pressure and minimize deflection. This can be achieved by a specific design shape and curvature, as well as general part thicknesses. By way of another example, functional components on the housing 102 such as buttons, knobs, and the like, can be designed to interact with gaskets and the housing structure to prevent water ingress at about 10 ATM pressure.

In implementations, the electronic component 104 is disposed within the housing 102 such that it is removable from the housing 102. For example, the electronic component 104 may be accessible in the housing 102 (e.g., for removal or otherwise) through the front 112 or back 114 of the housing 102. In an aspect, the back 114 may be removed via one or more of screws, pins, bolts, hinges, or the like, e.g., for accessing the electronic component 104.

The electronic component 104 may include wearable component such as a smartwatch as discussed herein. The electronic component 104 may also or instead include a mobile phone, a tablet, a personal digital assistant (PDA), a laptop or other computing device such as a hand-held computing device or a wearable computing device (e.g., watch, jewelry, or clothing), and so forth. In implementations, the housing 102 is structurally configured such that the electronic component 104 can be engaged with the housing 102, e.g., inserted within the void 106 of the housing 102. The electronic component 104 may also or instead include a plurality of electronic elements including without limitation one or more of an electronic display (e.g., OLED, AMOLED, LCD, and the like), a processor, a memory, circuitry, wiring, a sensor, a microphone, a speaker, a communications interface, a power supply, and so forth. The plurality of electronic elements may be contained within a modular unit or they may be separately dispersed within the housing 102 (e.g., in an embodiment where the housing 102 and electronic component 104 are integrated).

The electronic component 104 may include a microphone 108 for input and usability, e.g., for voice commands received from a user to perform different functionality for the electronic component 104. In an implementation where the electronic component 104 is disposed within the void 106 of the housing 102, the microphone 108 may work in conjunction with a port or aperture to allow sound to pass through from the external environment 110 to the void 106 to interact with its sound sensors. Similarly, other components or features of the electronic component 104 may work in conjunction with a port or aperture in communication with to the external environment 110. The device 100 may thus advantageously include a cam-lock mechanism as described herein to hermetically seal a port, aperture, or the like provided in the housing 102, e.g., on demand by a user. By sealing the port, the overall device 100 may maintain its structural integrity and sealing capabilities, e.g., substantially eliminating water ingress. The device 100 may further allow a user to unlock and open the port on demand, e.g., so that a user of the electronic component 104 (e.g., the wearer of a smartwatch) can allow the electronic component 104 to receive audio input for desired functionality and use.

The device 100 may further include a cam 130 and a slider 150, e.g., disposed on one or more of the side surfaces 116 of the housing 102, as described in more detail below.

Figure 2:
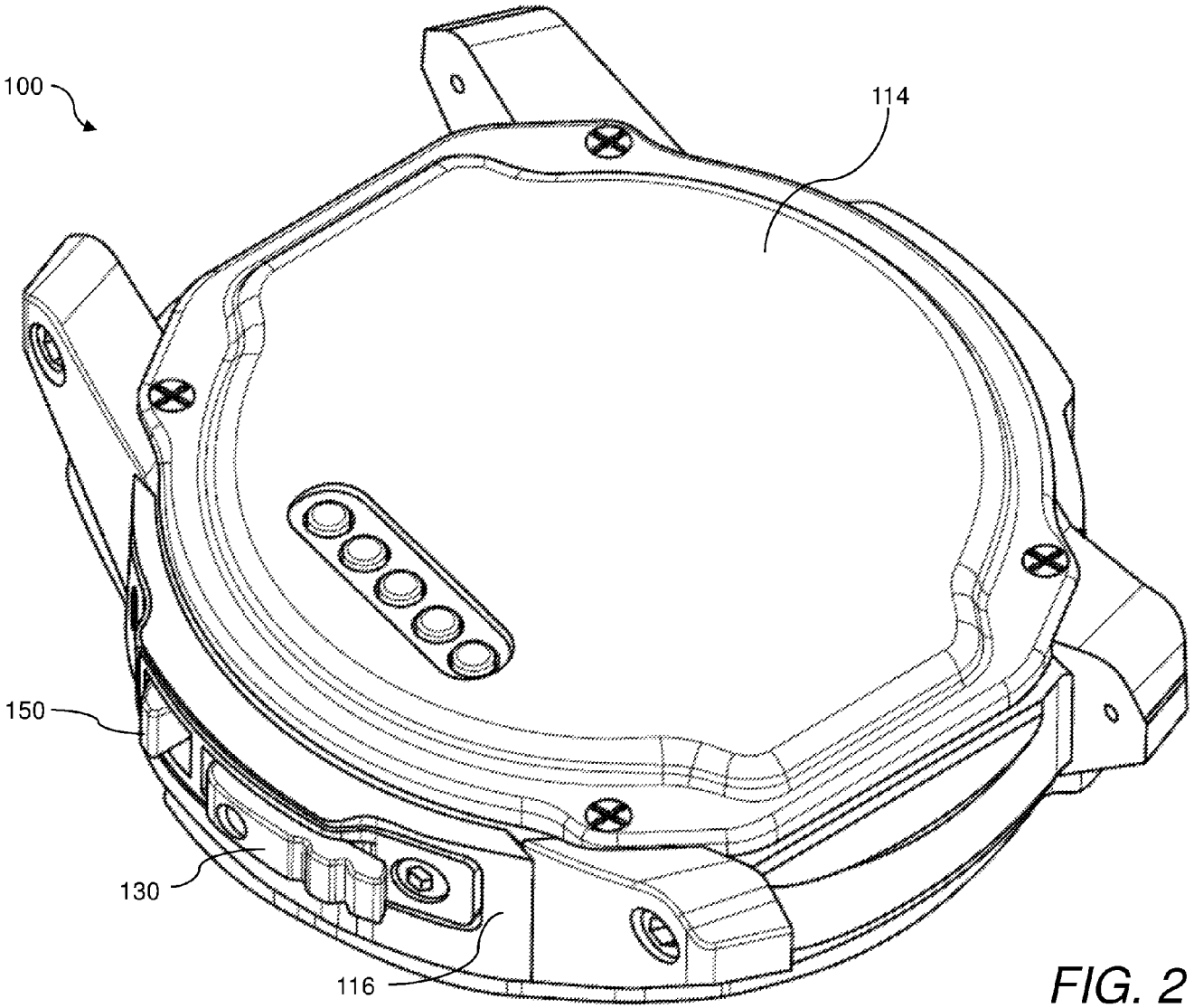
FIG. 2 is a perspective bottom view of a device according to an implementation.

FIG. 2 is a perspective bottom view of a device according to an implementation. Specifically, this figure clearly shows the back 114 of the device 100, and a side surface 116 featuring a cam 130 and a slider 150 as described herein.

Figure 3:
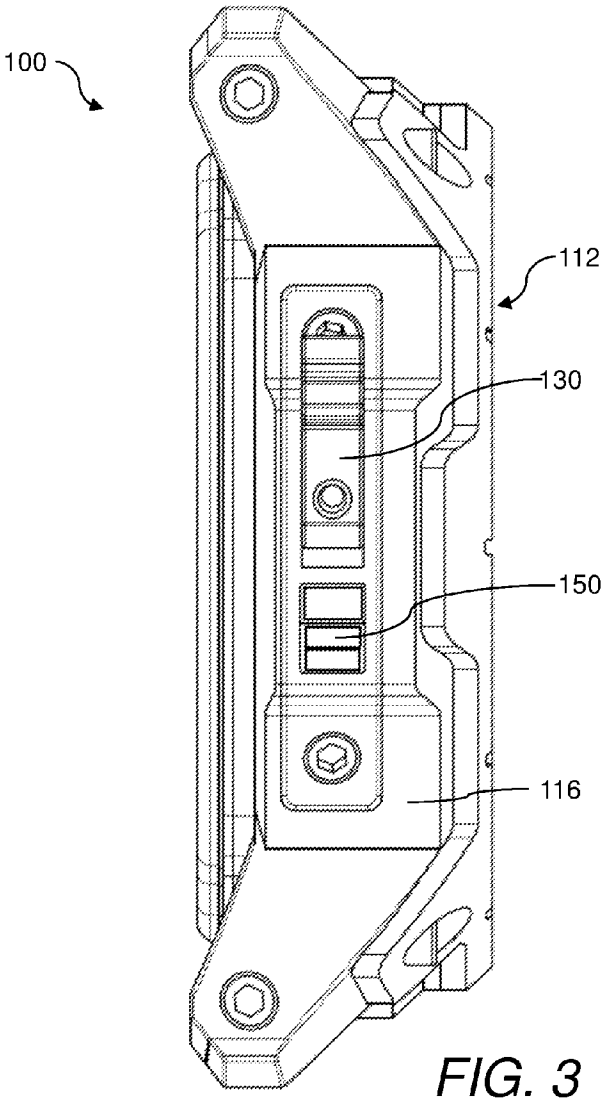
FIG. 3 is a left side view of a device according to an implementation.

FIG. 3 is a left side view of a device according to an implementation. As shown in the figure, in certain implementations, a side surface 116 on the left side of the device 100 includes a cam 130 and a slider 150 as described herein. The cam 130 and the slider 150 may also or instead be disposed on one or more of the right side of the device 100, the top side of the device 100, the bottom side of the device 100, and so on. In fact, implementations may include the cam 130 and the slider 150 on any surface of the device 100, e.g., the front 112 surface of the device 100, or combinations of surfaces of the device 100.

Figure 4:
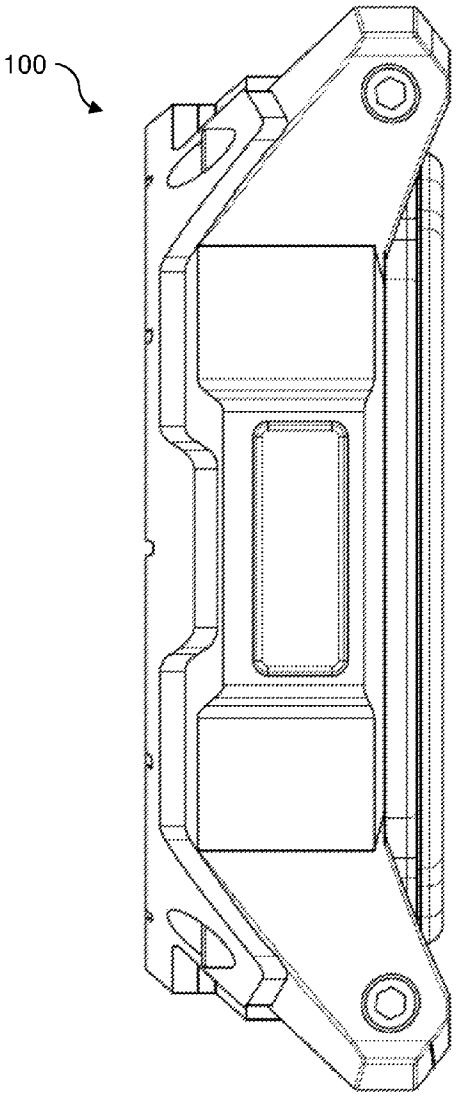
FIG. 4 is a right side view of a device according to an implementation.

FIG. 4 is a right side view of a device according to an implementation.

Figure 5:
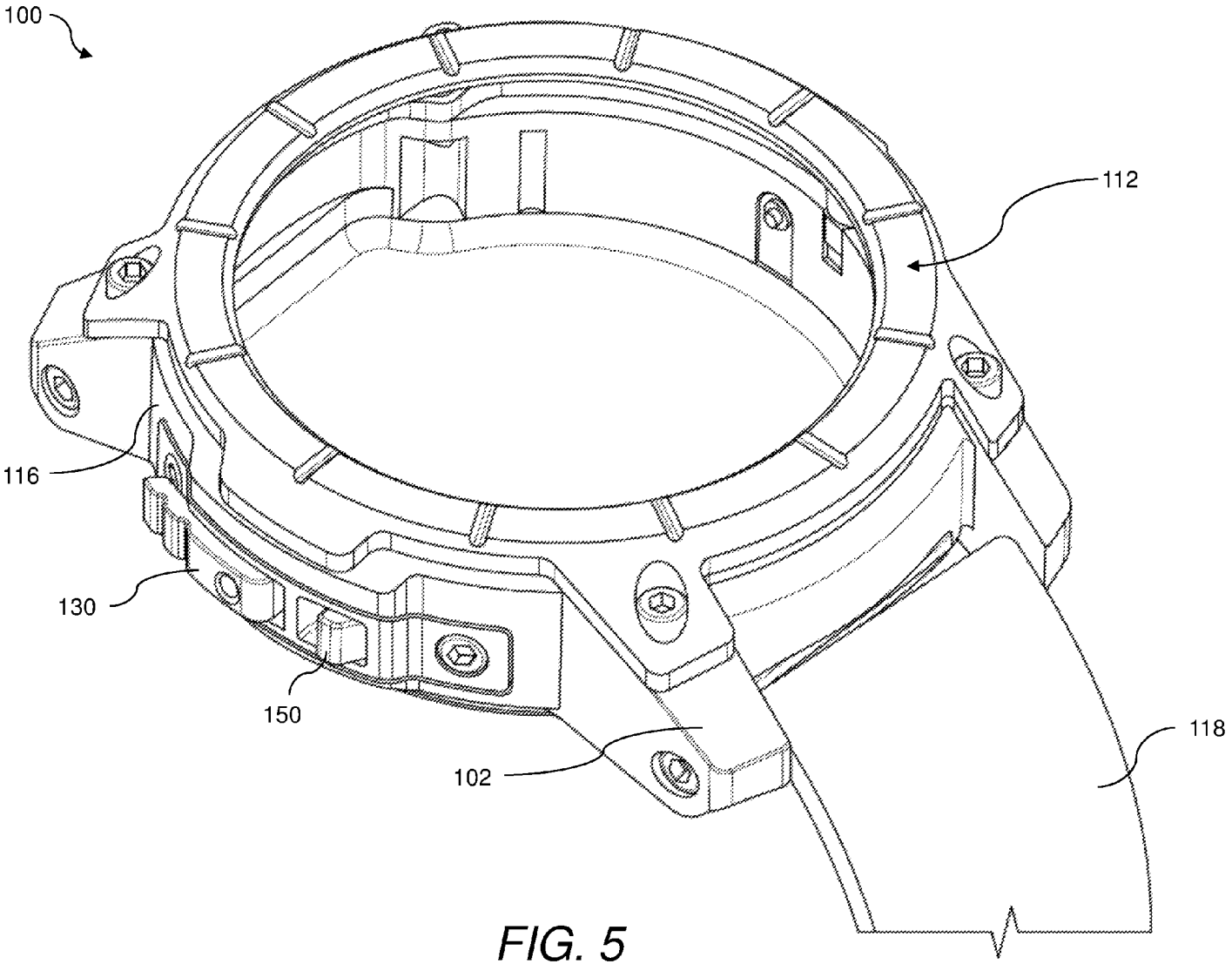
FIG. 5 is a perspective top view of a device according to an implementation.

FIG. 5 is a perspective top view of a device according to an implementation. As shown in the figure, the device 100 may include a strap 118 attached to the housing 102, where the strap 118 is structurally configured to engage the device 100 with a wrist of a user. This figure also clearly shows the front of the device 100, and a side surface 116 featuring a cam 130 and a slider 150 as described herein.

FIGS. 6-9 are cross-sections of a device according to an implementation. The device 100 may be the same or similar to the devices depicted in the figures above, or it may be a different device. In implementations, the device 100, or a component thereof, is structurally configured for releasably sealing a port for a wearable electronic component. The device 100 may include a housing 102, a cam 130, and a slider 150.

The housing 102 may be structurally configured for substantially hermetically sealing an electronic component such as any as described herein. The housing 102 may include a void 106 for receiving the electronic component within the housing 102. In general, the housing 102 may include a front, a back, and a side surface 116 disposed between the front and the back of the housing 102 and surrounding the void 106.

As shown in FIGS. 6-9, the cam 130 may be disposed on the side surface 116 of the housing 102. In an alternate embodiment, the cam 130 is disposed on one or more of the front or the back of the housing 102.

In general, the cam 130 may include an elongate body 132 having a proximal end 134 and a distal end 136, where the distal end 136 opposes the proximal end 134 on the body 132 of the cam 130 (i.e., the distal end 136 is located on one end of the body 132 and the proximal end 134 is located on an opposite end of the body 132 of the cam 130). It will be understood that the terms "proximal," "distal," and the like are words of convenience and could be substituted with words like "first," "second," and so forth, unless explicitly recited to the contrary or otherwise clear from the context.

Figure 6:
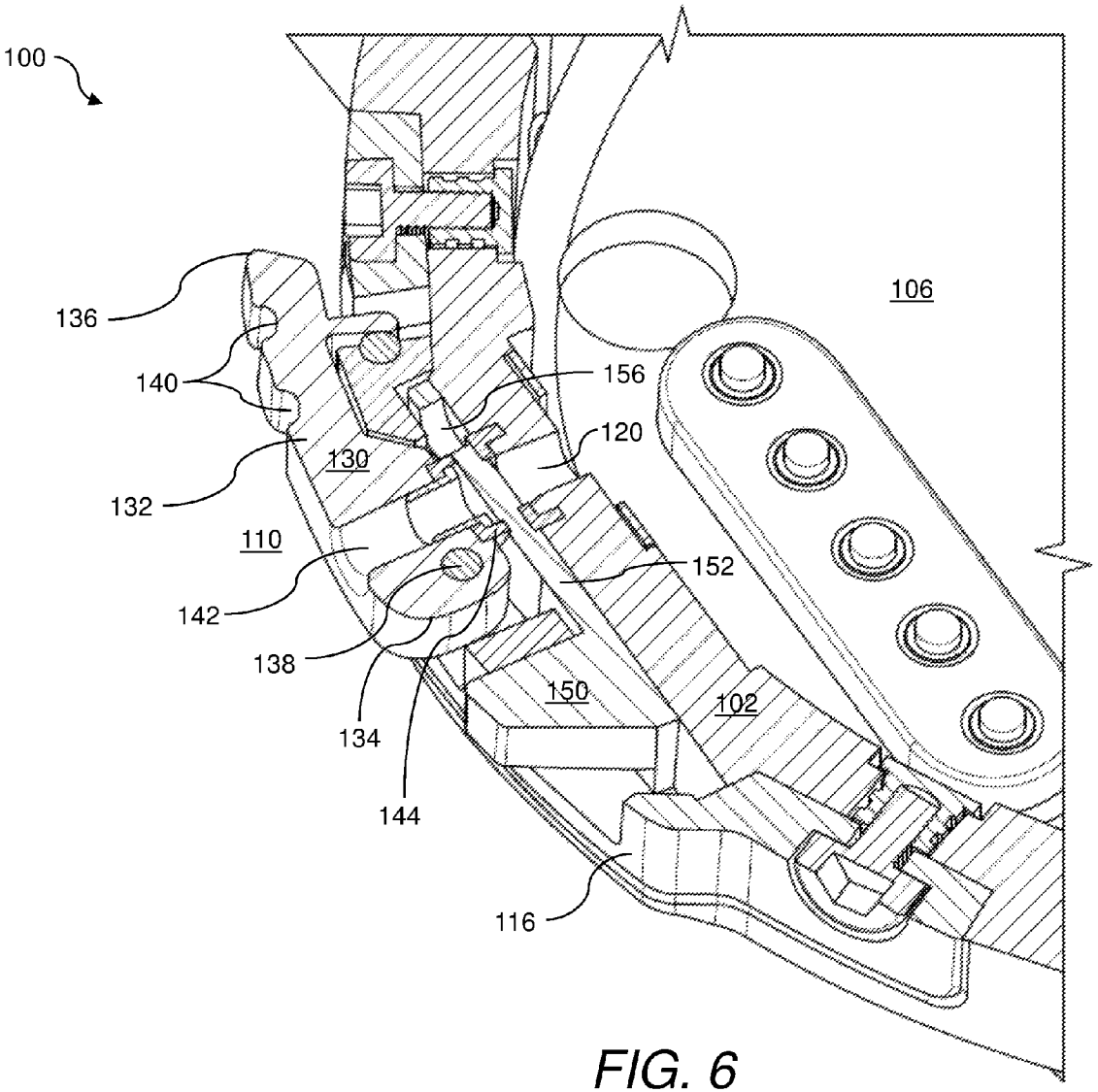
FIGS. 6-9 are cross-sections of a device according to an implementation.
Figure 7:
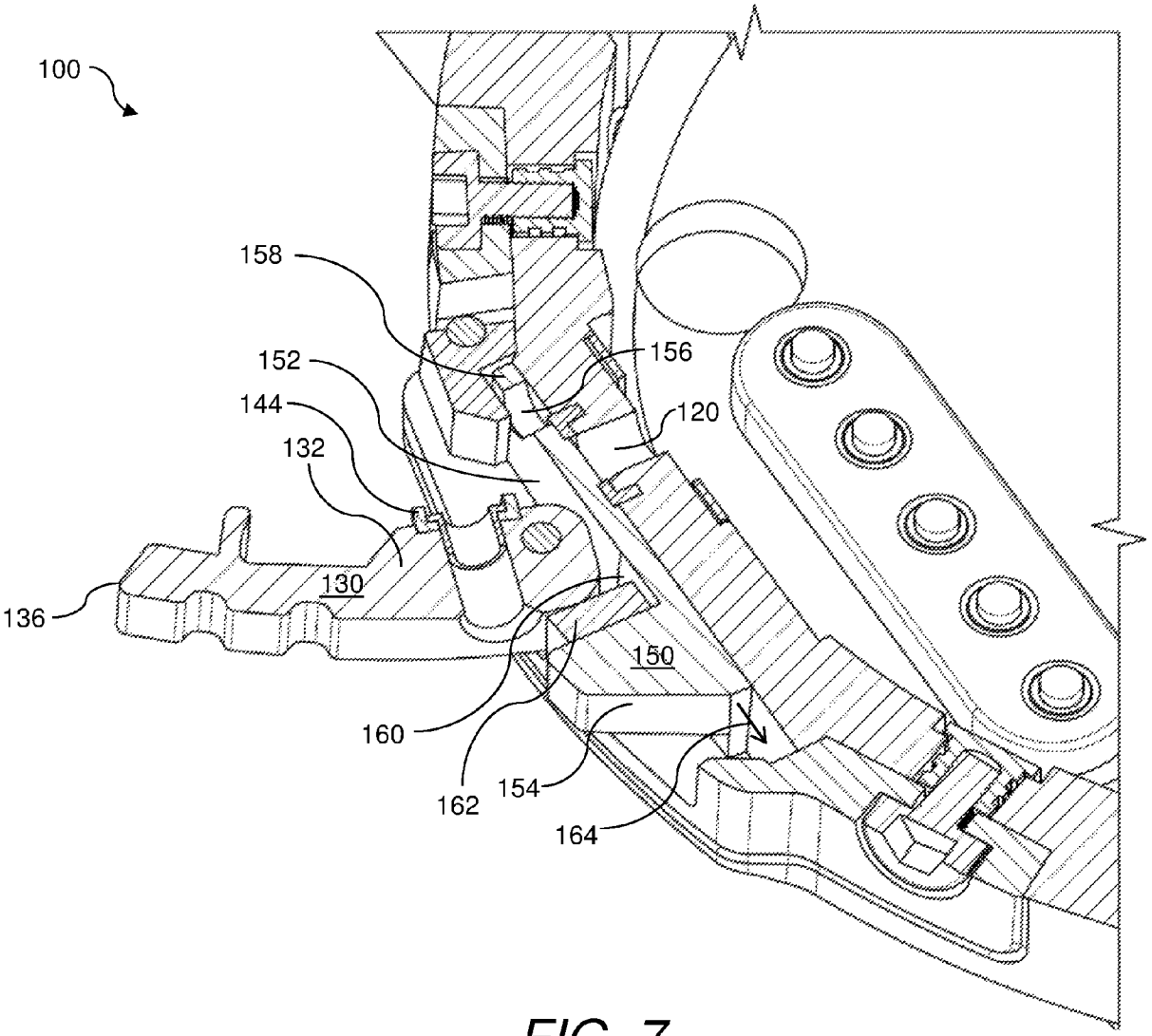
Figure 8:
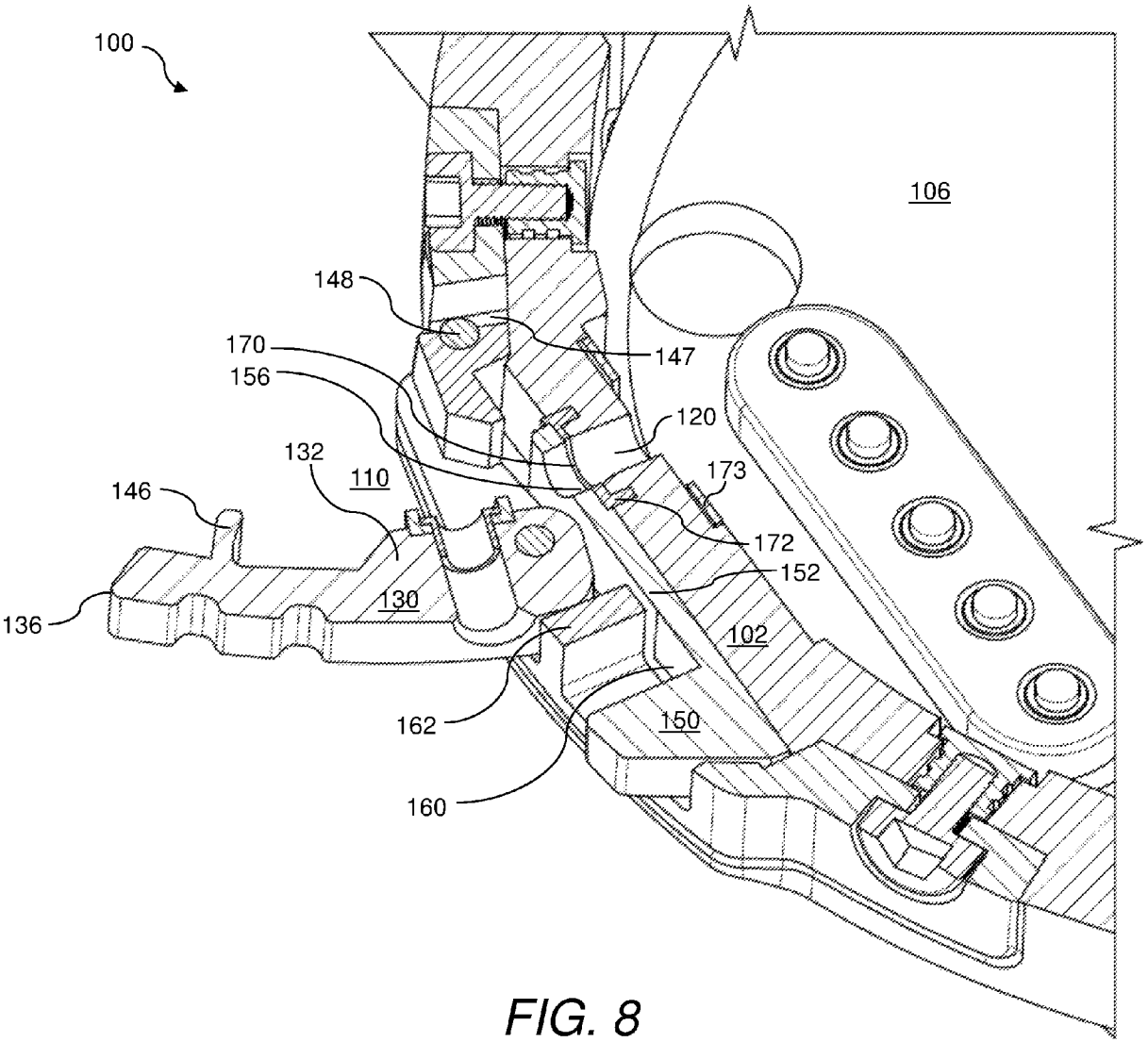
Figure 9:
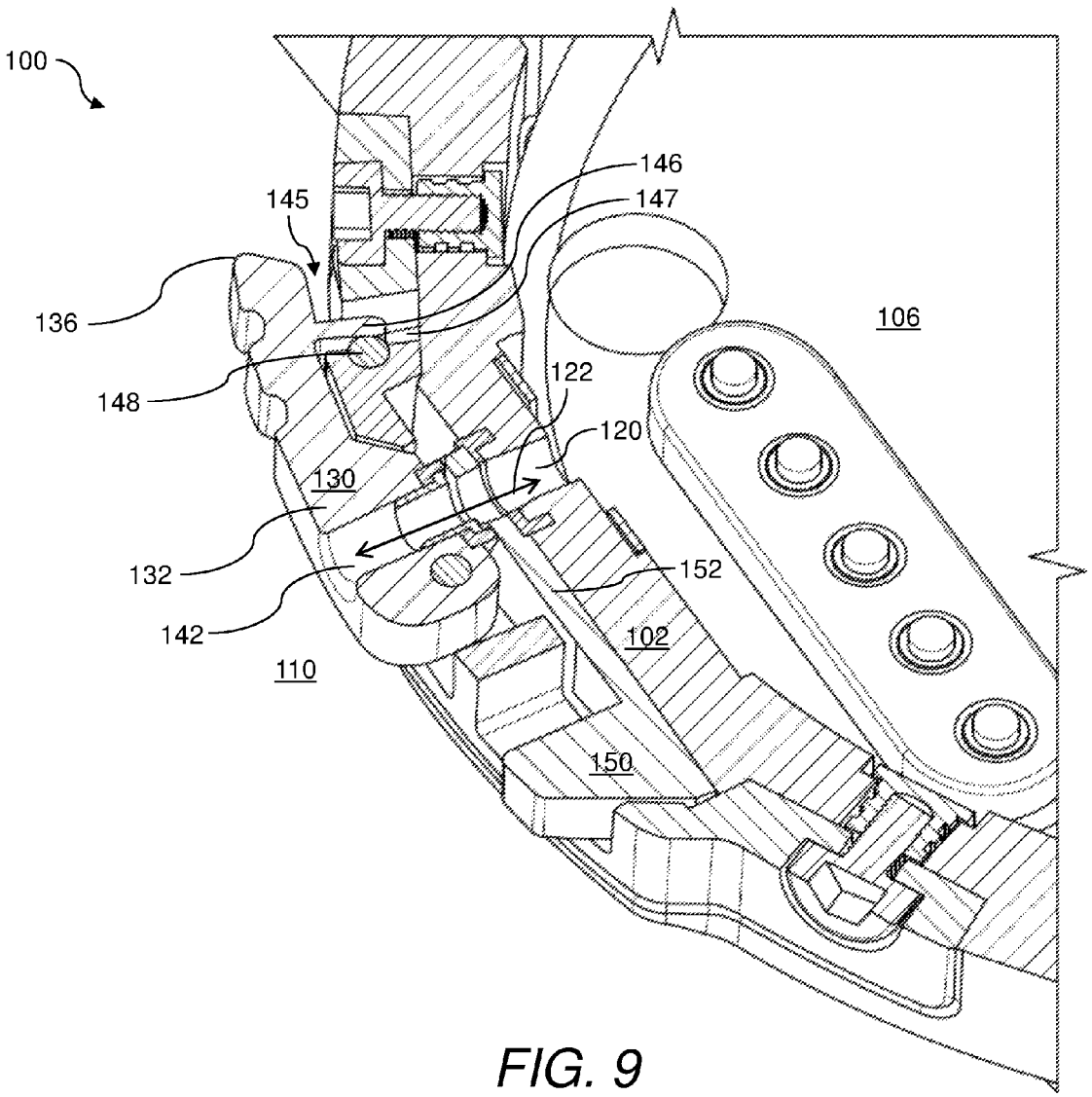

The proximal end 134 of the cam 130 may be pivotally engaged with the housing 102 between a first position where the distal end 136 is disposed adjacent to the housing 102 (e.g., as shown in FIGS. 6 and 9) and a second position where the distal end 136 is disposed away from the housing 102 (e.g., as shown in FIGS. 7 and 8). Pivoting of the cam 130 may be facilitated by a pivot point 138 (e.g., a pin, a bearing, a hinge, or the like), where the cam 130 is engaged with the pivot point 138 such that it is rotatable about the pivot point 138. The pivot point 138 may be disposed on the housing 102. Other attachments to facilitate movement of the cam 130 between the first position and the second position are also or instead possible. For example, one or more of a hinge, an articulating joint, a spring (e.g., a coil spring or a leaf spring), a toggle, a bearing, and the like may be implemented into one or more of the housing 102 or cam 130 to facilitate movement of the cam 130 between the first position and the second position. In certain implementations, once the distal end 136 is disengaged from the housing 102, the cam 130 may move freely between the first position and the second position. In other implementations, a force such as a spring force or the like directs the cam 130 into one or more of the first position and the second position.

The cam 130 may be shaped to facilitate its movement between the first position and the second position. For example, the proximal end 134 of the cam 130 may be shaped to facilitate pivoting (e.g., the proximal end 134 may be rounded as shown in the figure). The cam 130 may also or instead include one or more recesses 140, e.g., recesses 140 structurally configured to be utilized by a user to grip the cam 130 to move it between the first position and the second position. Similarly, the distal end 136 of the cam 130 may include a shape to facilitate gripping by a user, such as the inclined edge shown in the figure.

The cam 130 may include a cam port 142 disposed between the proximal end 134 and the distal end 136 of the cam 130. The cam port 142 may extend through the body 132 of the cam 130—e.g., the cam port 142 may be a hole through the cam 130. The cam port 142 may include a gasket 144 or the like on an end thereof for engagement with the slider 150. The gasket 144 may be formed by a ring or the like encircling an end of the cam port 142, e.g., where the ring is able to form a seal with the slider 150 when the cam 130 is in the first position. The gasket 144 may be made from one or more of a rubber (or another elastomer), a plastic, a metal, and so on.

The distal end 136 of the cam 130 may be engaged with the housing 102 when the cam 130 is in the first position. This engagement may be provided by a cam securing mechanism 145 or the like that engages the cam 130 with housing 102 when the cam 130 is in the first position (see FIG. 9). The cam securing mechanism 145 may include one or more features on the cam 130 and the housing 102, such as male and female features that engage with one another, for securing the cam 130 in the first position. For example, the cam securing mechanism 145 may include a projection 146 on the cam 130 structurally configured to create a friction fit with the housing 102 when received by a securement opening 147 in the housing 102 when the cam 130 is in the first position. In addition, the housing 102 may further include a protrusion 148 or the like, e.g., within or adjacent to the securement opening 147, that engages with the projection 146 of the cam 130. In an aspect, a force for disengaging the friction fit between the projection 146 and the securement opening 147 is selected such that a user can manually disengage the distal end 136 of the cam 130 from the housing 102 using one or more of a finger and a thumb. Other securing mechanisms are also or instead possible including without limitation a clamp, a clip, a dowel, a dock, a hook, a latch, a pin, a snap, and so forth.

The slider 150 may be disposed on the side surface 116 of the housing 102. In an alternate embodiment, the slider is disposed on one or more of the front or the back of the housing 102. The slider 150 may be disposed on the housing 102 such that it is at least partially disposed between the cam 130 and the void 106. In other words, the cam 130 may be disposed on one side of the slider 150, and the void 106 and/or a wall of the housing 102 may be disposed on the other side of the slider 150.

The slider 150 may be slidably engaged with the housing 102 between a sealed position where a body 152 of the slider 150 substantially seals the void 106 from an external environment 110 (e.g., as shown in FIGS. 6 and 7) and an open position where the body 152 of the slider 150 does not seal the void 106 from the external environment 110 (as shown in FIGS. 8 and 9).

The slider 150 may generally include a substantially flat, elongate body 152, e.g., suitable for creating a seal with the gasket 144 of the cam 130 when the cam 130 is in the first position and the slider 150 is in the sealed position. The slider 150 may also or instead include engagement mechanisms to facilitate engagement with the cam 130 in one or more of the sealed position or the open position. This may include recesses or protrusions included on the slider 150 that engage with cooperating features on the cam 130. The slider 150 may also or instead include a gasket or the like.

The slider 150 may include a slider port 156 in the body 152 of the slider 150 that is offset from the opening 120 of the housing 102 when the slider 150 is in the sealed position (as shown in FIGS. 6 and 7) and that is aligned with the opening 120 of the housing 102 when the slider 150 is in the open position (as shown in FIGS. 8 and 9). The slider port 156 may generally be disposed on a distal end 158 of the slider 150. The slider port 156 may include a hole disposed through the body 152 of the slider 150. The slider port 156 may be sized and shaped such that portions of the slider 150 surrounding the slider port 156 will engage portions of the body 132 of the cam 130 (e.g., the gasket 144) such that the cam 130 applies a force onto the slider 150 when the slider 150 is in its open position thereby maintaining the slider 150 in the open position when the cam 130 is in the first position. In an alternate embodiment, the distal end 158 of the slider 150 may be completely open such that no port need be formed therein and the passage between the void 106 and the external environment 110 is unobstructed when the slider 150 is in the open position.

As best shown in FIGS. 7 and 8, the slider 150 may include a surface 160 that is at least partially concealed when the slider 150 is in the sealed position (e.g., as shown in FIG. 7) and at least partially exposed or otherwise visible from an external environment 110 when the slider 150 is in the open position (e.g., as shown in FIG. 8). The surface 160 may include a marking or the like disposed thereon. The marking, or the surface 160 generally, may provide an indication to a user about whether the slider 150 is in the open position or the sealed position. For example, the marking on the surface 160, or the surface 160 generally, may be substantially concealed from the user by a covering 162 on the housing 102 when the slider 150 is in the sealed position (e.g., as shown in FIG. 7) and the marking, or the surface 160 generally, may be visible to the user when the slider 150 is in the open position (e.g., as shown in FIG. 8). The marking on the surface 160 may include one or more of a conspicuous color, design, or material such that it stands out to a user (e.g., a reflective material, a bright/distinctive color, a pattern, and so on).

As shown in FIG. 8, the device 100 may further include a membrane 170 disposed between the external environment 110 and the void 106. In one aspect, the membrane 170 is disposed in the opening 120 of the housing 102. The membrane 170 may also or instead be disposed in other locations, e.g., in the cam port 142, in the slider port 156, as part of the gasket 144 of the cam 130 or a gasket 172 provided on the opening 120 of the housing 102, in the void 106, integral with a microphone of an electronic component, and so on. The membrane 170 may be a gas permeable membrane that provides a secondary barrier, e.g., permitting air flow while preventing the ingress of debris (e.g., oil, sand, liquid, and the like) into the void 106 of the housing 102. The membrane 170 may include one or more of a fabric and a metallic mesh. The fabric of the membrane 170 may include a waterproof, breathable fabric such as those supplied under the trademark GORE-TEX® or the like.

As referenced above, the opening 120 of the housing 102 may include a gasket 172 for engaging the slider 150. The gasket 172 may be the same or similar to the gasket 144 included on the cam 130. In another embodiment, the slider 150 also or instead includes a gasket, e.g., on either side of the body 152 of the slider 150 for engaging one or more of the cam 130 and the housing 102 in one or more of the sealed position or the open position. In certain implementations, the slider 150 includes a gasket disposed around the slider port 156. In other implementations, the opening 120 of the housing 102 includes an interior gasket 173 or seal that engages with the electronic component 104, e.g., a port of the electronic component 104.

As discussed above, FIG. 6 shows the cam 130 in the first position and the slider 150 in the sealed position; FIG. 7 shows the cam 130 in the second position and the slider 150 in the sealed position; FIG. 8 shows the cam 130 in the second position and the slider 150 in the open position; and FIG. 9 shows the cam 130 in the first position and the slider 150 in the open position.

In the configuration of FIG. 6, i.e., when the cam 130 is in the first position and the slider 150 is in the sealed position, the slider 150 may be prevented from sliding to the open position by an engagement between the body 132 of the cam 130 and the body 152 of the slider 150. In implementations, when the cam 130 is in the first position, the cam 130 provides an inward force on the body 152 of the slider 150 against the housing 102. The inward force may prevent the slider 150 from sliding when the cam 130 is in the first position. In this manner, the inward force may form the engagement between the body 132 of the cam 130 and the body 152 of the slider 150 that prevents the slider 150 from sliding. The inward force provided by the cam 130 onto the slider 150 when the cam 130 is in the first position may occur when the slider 150 is in the sealed position, when the slider 150 is in the open position, or both. The inward force may press the slider 150 against the housing 102 in an implementation.

In the configuration of FIGS. 7 and 8, i.e., when the cam 130 is in the second position, the engagement between the body 132 of the cam 130 and the body 152 of the slider 150 may be released, e.g., completely or partially. Releasing the engagement between the body 132 of the cam 130 and the body 152 of the slider 150 may permit the slider 150 to slide freely between the sealed position (as shown in FIG. 7) and the open position (as shown in FIG. 8). The slider 150 may also or instead include an engagement with the housing 102 (and/or one or more mechanical elements, such as protrusions, fittings, or springs) such that a force is needed to move the slider 150 from the sealed position to the open position and vice-versa. In general, the slider 150 may be sized and shaped such that a user can use their finger or thumb to move the slider 150 between the sealed position and the open position when the cam 130 is in the second position. For example, a proximal end 154 of the slider 150 may include a substantially bulbous shape, which can include one or more inclined surfaces or other features that promote gripping of the slider 150 by a user at its proximal end 154.

In the configuration of FIG. 9, i.e., when the cam 130 is in the first position and the slider 150 is in the open position, the cam port 142 may be aligned with an opening 120 of the housing 102 thereby forming a passage (e.g., shown by the arrows 122) between the external environment 110 and the void 106. As discussed above, in an aspect, when the cam 130 is in the first position and the slider 150 is in the open position, the cam 130 provides an inward force on the body 152 of the slider 150 against the housing 102, which may form the engagement between the body 132 of the cam 130 and the body 152 of the slider 150, where the engagement prevents the slider 150 from sliding to the sealed position.

An example of a use case with respect to FIGS. 6-9 will now be discussed. As discussed above, the device 100 shown in the figures may include an electronic component disposed within the void 106, where the electronic component includes a microphone. The void 106 may thus be structurally configured to receive the electronic component in a predetermined orientation such that the microphone is disposed near the opening 120 of the housing 102 (e.g., adjacent to the opening 120). The electronic component may include a smartwatch (or a component thereof) or the like. The housing 102 may provide a substantially hermetic seal that creates a substantially soundproof environment in the void 106 when the cam 130 is in the first position and the slider 150 is in the sealed position, e.g., such that the microphone of an electronic component is substantially isolated from noises or debris in the exterior environment 110. This may be advantageous when a wearer of the electronic component (e.g., smartwatch) is in an environment that could damage the electronic component or port thereof, e.g., surfing, swimming, skiing, snowboarding, and so on. It may also or instead be advantageous to prevent unwanted voice commands from being received by the electronic component. When the slider 150 is in the open position, however, the passage between the external environment 110 and the void 106 may enable fluid communication between the external environment 110 and the void 106 such as to allow sound waves to travel from the external environment 110 to the void 106.

A user may encounter the device 100 in the configuration shown in FIG. 6, where the cam 130 is secured against the housing 102 in the first position and the slider 150 is in the sealed position. This configuration may provide a state in which the electronic component within the void 106 is protected in a waterproof/soundproof environment where the microphone would not function through a user attempting to speak into it, e.g., using voice commands. To use the microphone, the user may 'unlock' the cam 130, by moving the cam 130 to the second position as shown in FIG. 7. However, because the slider 150 is still in its sealed position, the electronic component may still not be accessible to the user through speaking into the microphone. When the cam 130 is in the second position, the user may then slide the slider 150 (e.g., along an axis substantially parallel with the side surface 116 of the housing 102—in a direction as shown by arrow 164) to open the passage to the void 106 as shown in FIG. 8, and thus to open a passage to an electronic component with a microphone disposed within the void 106. As discussed herein, the void 106 and thus the electronic component may still be protected by a membrane 170, e.g., protected from contaminant ingress such as water (e.g., from splashing when swimming or surfing), sand, dirt, oil, and the like. Because the passage between the external environment 110 and the void 106 is open when the slider 150 is slid into its open position, a user may be able to speak into the microphone of the electronic component that is disposed within the housing 102. If a user wishes to 'lock' the slider 150 in its open position (or otherwise place the cam 130 into its first position while the slider 150 is open, e.g., for ergonomic or aesthetic reasons, the user may move the cam 130 back into the first position as shown in FIG. 9.

Figure 11:
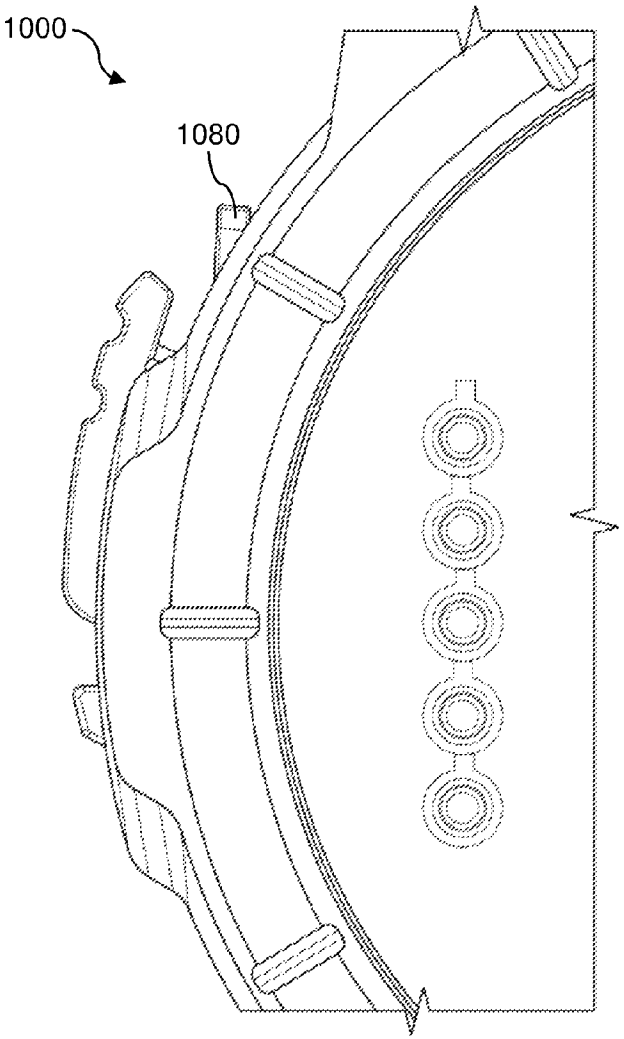
FIGS. 10 and 11 are top views of a device according to an implementation.
Figure 10:
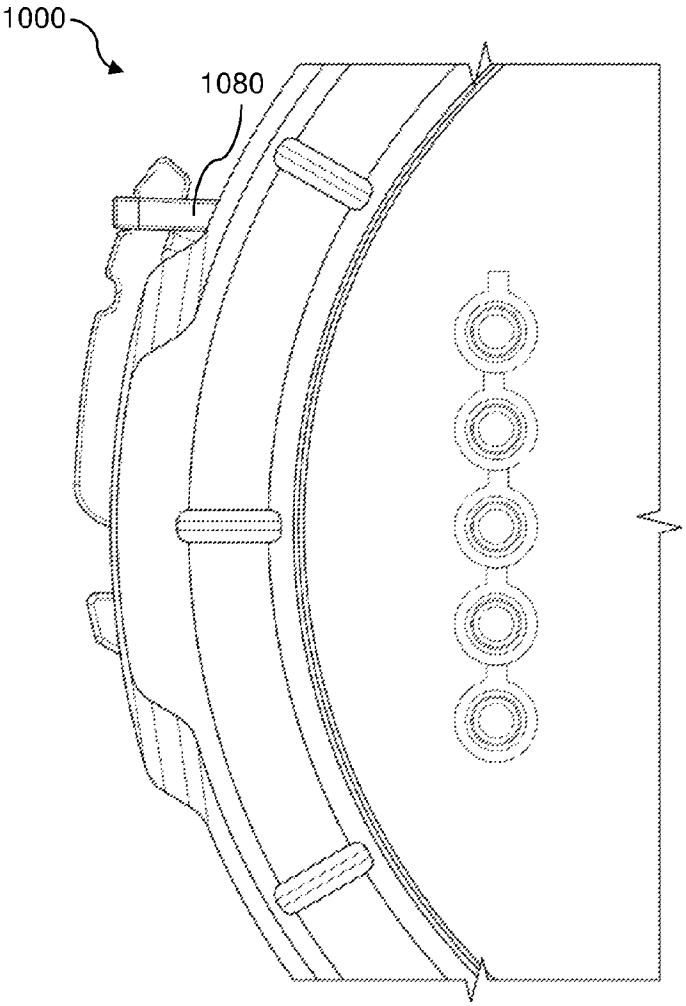
Figure 12:
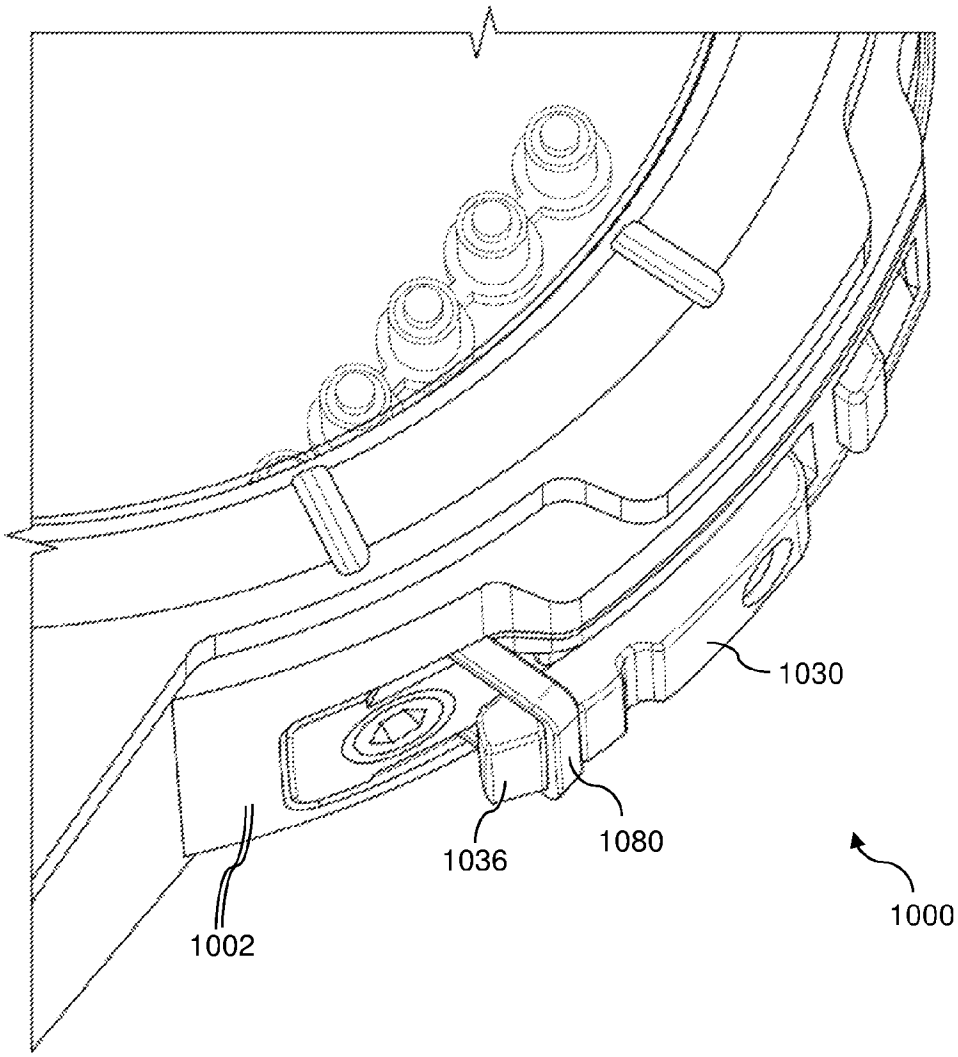
FIGS. 12-14 are top perspective views of a device according to an implementation.
Figure 13:
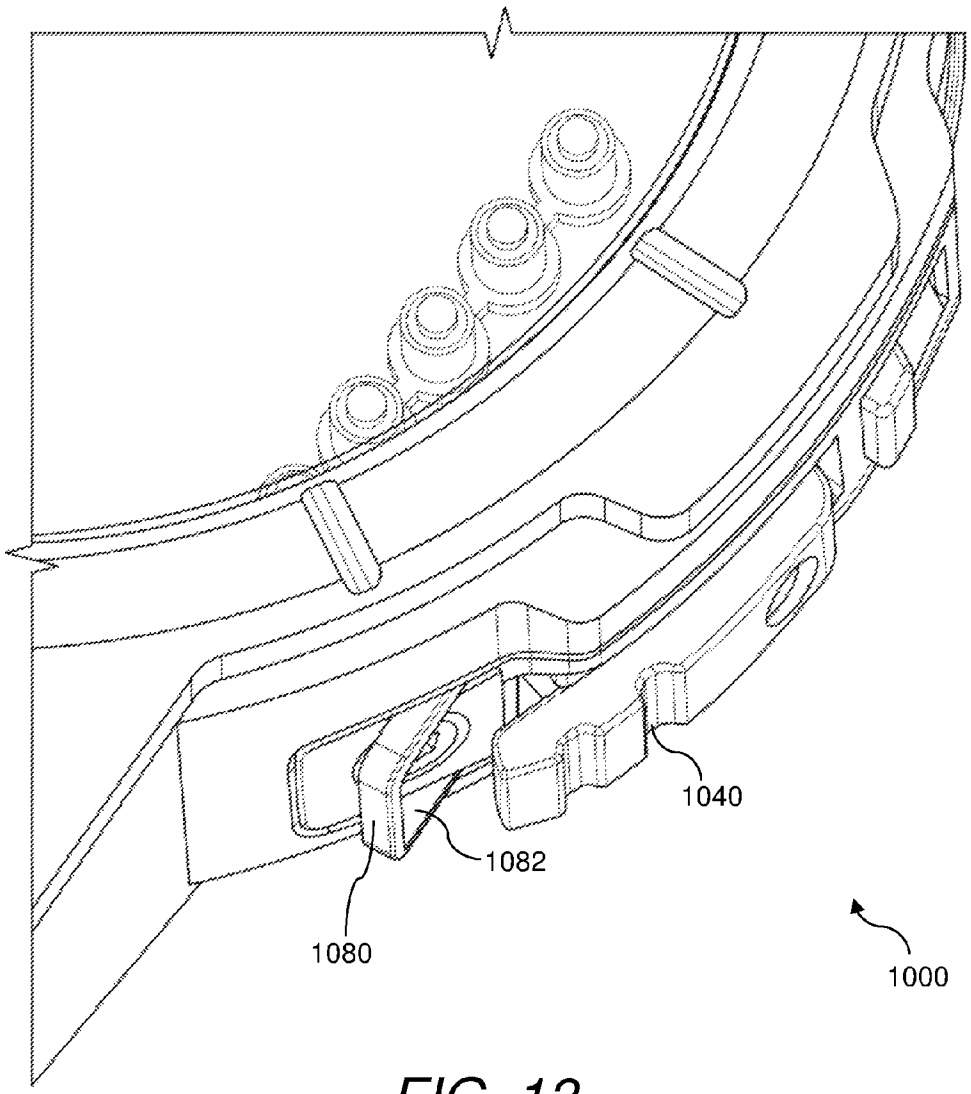
Figure 14:
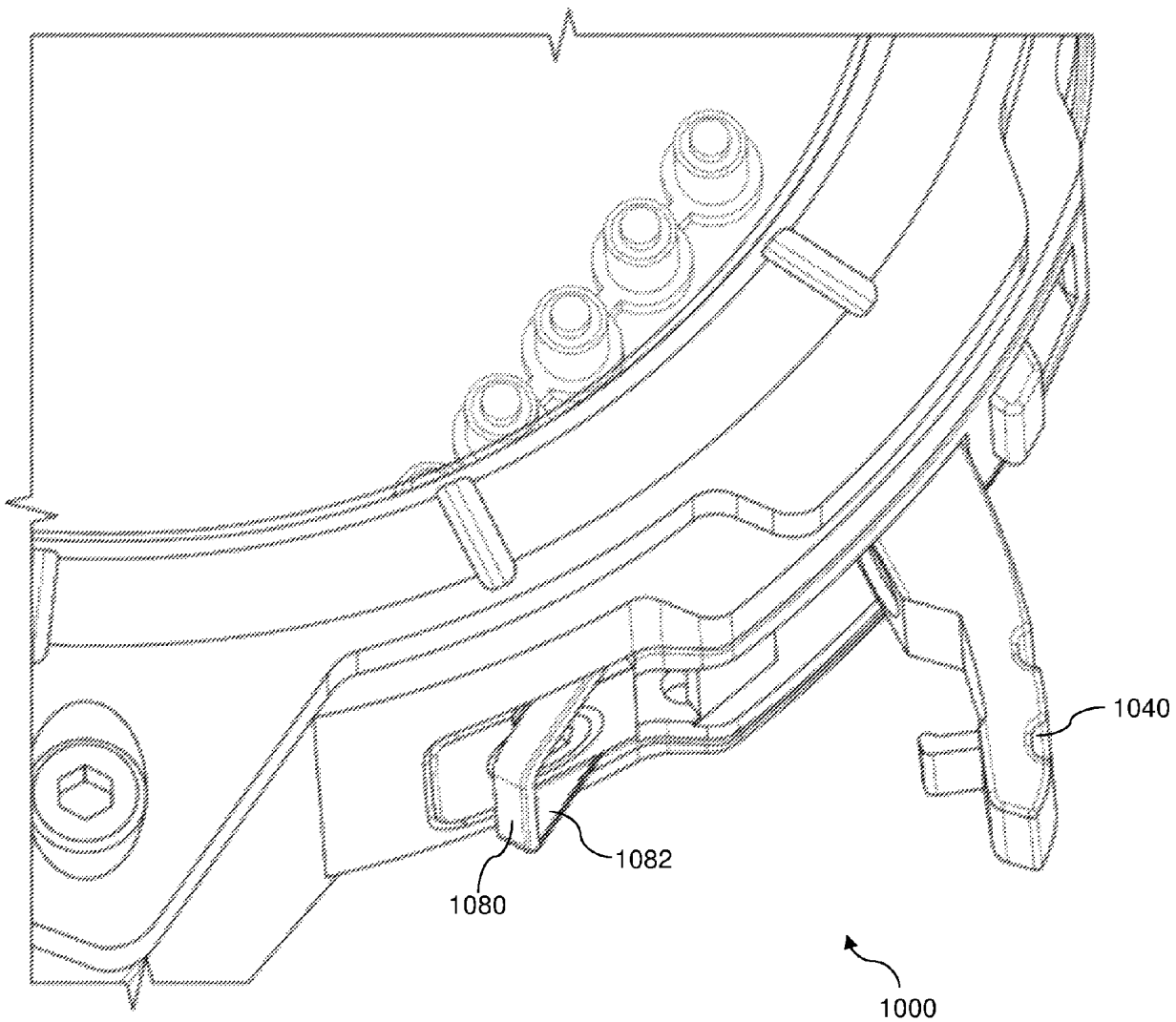

FIGS. 10 and 11 are top views of a device according to an implementation, and FIGS. 12-14 are top perspective views of a device according to an implementation. The implementations shown in FIGS. 10-14 may include a device 1000 similar to those discussed above, but that further includes a cam locking mechanism 1080.

The cam locking mechanism 1080 may be disposed on the housing 1002 for securing the distal end 1036 of the cam 1030 adjacent to the housing 1002 when the cam 1030 is in the first position, e.g., as shown in FIGS. 10 and 12. As shown in the figures, the cam locking mechanism 1080 may include a latch pivotally engaged with the housing 1002. The latch may include an aperture 1082 for receiving the distal end 1036 of the cam 1030. The cam 1030 may include one or more recesses 1040 for receiving the latch.

As shown in FIGS. 10-14, once the cam 1030 is placed in the first position, a user may manually place a latch or the like over the distal end 1036 of the cam 1030 and into a recess 1040 included on the cam 1030. This engagement may secure the distal end 1036 of the cam 1030 adjacent to the housing 1002 when the cam 1030 is in the first position. To move the cam 1030 to the second position, a user may manually pivot the latch or the like off of the cam 1030 thereby allowing the distal end 1036 of the cam 1030 to be moved away from the housing 1002. In this manner, the cam securing mechanism discussed above (e.g., the cam securing mechanism 145 shown and described with reference to FIG. 9) can be thought of as a 'first lock' for the device and the cam locking mechanism 1080 can be thought of a 'second lock' for the device. Alternatively, only one of the cam securing mechanism and the cam locking mechanism 1080 may be present in an implementation.

The cam locking mechanism 1080 may also or instead include other mechanical features for engaging or mating the cam 1030 to the housing 1002 including without limitation one or more of a clip, a dowel, a docking device, a friction fit, a holding member, a hook, a pin, a screw, a snap, and so forth.

It will be appreciated that the devices, systems, and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So, for example, performing the step of X includes any suitable method for causing another party such as a remote user, a remote processing resource (e.g., a server or cloud computer) or a machine to perform the step of X. Similarly, performing steps X, Y and Z may include any method of directing or controlling any combination of such other individuals or resources to perform steps X, Y and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It should further be appreciated that the methods above are provided by way of example. Absent an explicit indication to the contrary, the disclosed steps may be modified, supplemented, omitted, and/or re-ordered without departing from the scope of this disclosure.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A device for releasably sealing a port for a wearable electronic component, comprising:

a housing structurally configured to substantially hermetically seal an electronic component, the housing including a void for receiving the electronic component within the housing, and the housing including a front, a back, and a side surface disposed between the front and the back of the housing, where the side surface is surrounding the void;

a cam disposed on the side surface of the housing, the cam including a proximal end and a distal end opposing the proximal end, the proximal end pivotally engaged with the housing between a first position where the distal end is disposed adjacent to the housing and a second position where the distal end is disposed away from the housing, the cam including a cam port disposed between the proximal end and the distal end of the cam that extends through a body of the cam; and a slider disposed on the side surface of the housing at least partially between the cam and the void, the slider slidably engaged with the housing between a sealed position where a body of the slider substantially seals the void from an external environment and an open position where the body of the slider does not seal the void from the external environment, wherein, when the cam is in the first position and the slider is in the sealed position, the slider is prevented from sliding to the open position by an engagement between the body of the cam and the body of the slider, wherein, when the cam is in the second position, the engagement between the body of the cam and the body of the slider is released thereby permitting the slider to slide between the sealed position and the open position, and wherein, when the cam is in the first position and the slider is in the open position, the cam port is aligned with an opening of the housing thereby forming a passage between the external environment and the void.

2. The device of claim 1, further comprising the electronic component disposed within the void, the electronic component including a microphone.

3. The device of claim 2, wherein the void is structurally configured to receive the electronic component in a predetermined orientation such that the microphone is disposed near the opening of the housing.

4. The device of claim 2, wherein the electronic component is a smartwatch.

5. The device of claim 1, wherein, when the cam is in the first position, the cam provides an inward force on the body of the slider against the housing, the inward force preventing the slider from sliding.

6. The device of claim 1, wherein the slider includes a slider port in the body of the slider that is offset from the opening of the housing when the slider is in the sealed position and that is aligned with the opening of the housing when the slider is in the open position.

7. The device of claim 1, wherein the distal end of the cam is engaged with the housing when the cam is in the first position.

8. The device of claim 7, further comprising a cam securing mechanism that engages the cam with housing when the cam is in the first position.

9. The device of claim 8, wherein the cam securing mechanism includes a projection on the cam structurally configured to create a friction fit with the housing when received by a securement opening in the housing when the cam is in the first position.

10. The device of claim 9, wherein a force for disengaging the friction fit between the projection and the securement opening is selected such that a user can manually disengage the distal end of the cam from the housing using one or more of a finger and a thumb.

11. The device of claim 1, wherein a substantially hermetic seal provided by the housing creates a substantially soundproof environment in the void when the cam is in the first position and the slider is in the sealed position.

12. The device of claim 1, wherein the passage between the external environment and the void enables fluid communication between the external environment and the void when the slider is in the open position.

13. The device of claim 12, wherein the fluid communication allows sound waves to travel from the external environment to the void.

14. The device of claim 1, further comprising a membrane disposed between the external environment and the void.

15. The device of claim 14, wherein the membrane is disposed in the opening of the housing.

16. The device of claim 14, wherein the membrane comprises one or more of a fabric and a metallic mesh.

17. The device of claim 1, further comprising a strap attached to the housing structurally configured to engage the device with a wrist of a user.

18. The device of claim 1, further comprising a cam locking mechanism disposed on the housing for securing the distal end of the cam adjacent to the housing when the cam is in the first position.

19. The device of claim 18, wherein the cam locking mechanism includes a latch pivotally engaged with the housing, the latch including an aperture for receiving the distal end of the cam.

20. The device of claim 19, wherein the cam includes one or more recesses for receiving the latch.

* * * * *